US005304983A

United States Patent [19]

Zhou et al.

[11] Patent Number: 5,304,983

[45] Date of Patent: Apr. 19, 1994

[54] MULTIPLE PULSE RESPONDER AND DETECTION SYSTEM AND METHOD OF MAKING AND USING SAME

[75] Inventors: Peter Y. Zhou, Smithtown; John Dunn, Merrick, both of N.Y.; Charles D. Graham, Ardmore; Kyung-Ho Shin, Philadelphia, both of Pa.

[73] Assignee: Knogo Corporation, Hauppauge, N.Y.

[21] Appl. No.: 803,330

[22] Filed: Dec. 4, 1991

[51] Int. Cl.[5] ..... G08B 13/14

[52] U.S. Cl. ..... 340/572; 340/505; 340/526; 148/108

[58] Field of Search ..... 340/572, 551, 309.15, 340/505, 825.54, 526; 148/103, 108; 428/611; 360/113

[56] References Cited

U.S. PATENT DOCUMENTS

| | | | |
|---|---|---|---|
| 2,988,466 | 6/1961 | Meikeljohn | 148/108 X |
| 3,765,007 | 10/1973 | Elder | 340/572 |
| 4,274,090 | 6/1981 | Cooper | 340/572 |
| 4,326,198 | 4/1982 | Novikoff | 340/572 |
| 4,623,877 | 11/1986 | Buckens | 340/572 |
| 4,660,025 | 4/1987 | Humphrey | 340/572 |
| 4,800,457 | 1/1989 | Kryder et al. | 360/113 |
| 4,857,893 | 8/1989 | Carroll | 340/572 |
| 4,945,339 | 7/1990 | Yamachi et al. | 340/551 |
| 4,950,550 | 8/1990 | Radeloff et al. | 428/611 |
| 5,017,907 | 5/1991 | Cordery et al. | 340/551 |
| 5,029,291 | 7/1991 | Zhou et al. | 340/551 |

FOREIGN PATENT DOCUMENTS

| | | |
|---|---|---|
| 0078401 | 5/1983 | European Pat. Off. . |
| 0170854 | 2/1986 | . |
| 3824075 | 1/1990 | Fed. Rep. of Germany . |
| 61-250162 | 11/1986 | Japan . |
| 2167627 | 5/1986 | United Kingdom . |

OTHER PUBLICATIONS

Wing Kei Ho, et al., Anisotropy Pinning of Domain Walls in Soft Magnetic Material, Aug. 1989 IEEE.

Exchange Anisotropy, 1977, pp. 43–45 Permanent Magnets.

Meikeljohn, et al., "New Magnetic Anisotropy" Jun. 1, 1956, pp. 1413–1414 Physical Review, vol. 102, No. 5.

Yoshimoto, et al., "Anomalous Eddy Current Loss and Amorphous Magnetic Materials with Low Core Loss", pp. 1893–1898, J. Appl. Phys. 52(3) Mar. 1981.

*Primary Examiner*—Thomas Mullen

*Attorney, Agent, or Firm*—Fitzpatrick, Cella, Harper & Scinto

[57] ABSTRACT

A responder for electronic article surveillance apparatus is made by subjecting a plurality of magnetizable elements to heating in the presence of a magnetic field and maintaining the field at a different intensity for each element as it is cooled to provide different magnetic characteristics so that when the responder is subjected to a cyclically varying magnetic interrogation field its several elements produce spaced apart pulses in each cycle.

18 Claims, 4 Drawing Sheets

FIG. 1
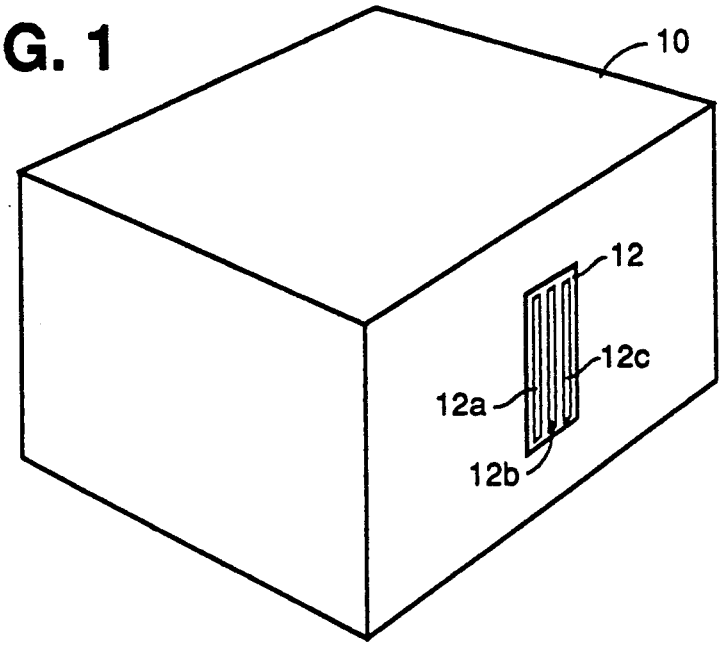
FIG. 2
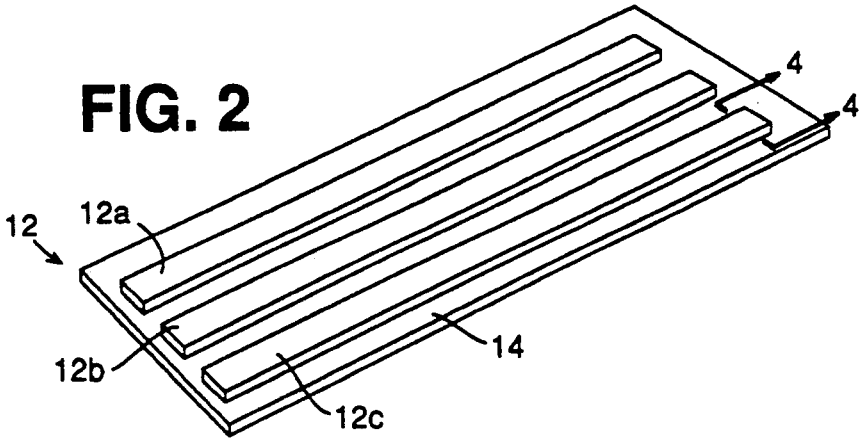
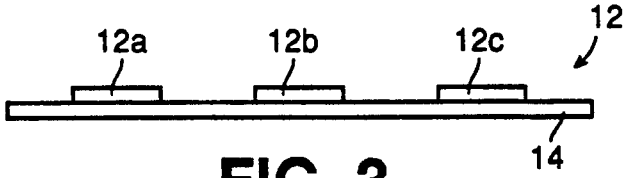
FIG. 3
FIG. 4
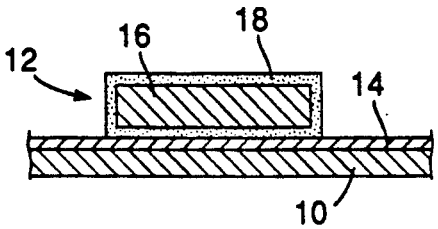

MULTIPLE PULSE RESPONDER AND DETECTION SYSTEM AND METHOD OF MAKING AND USING SAME

BACKGROUND OF THE INVENTION

1. Field of the Invention

This invention relates to electronic article surveillance and in particular it concerns novel responders and novel responder detection systems as well as novel methods for making and using same.

2. Description of the Prior Art

U.S. Pat. No. 4,623,877, in the name of Pierre F. Buckens and assigned to the assignee of the present invention, shows and describes an electronic article surveillance system in which articles of merchandise, e.g. books, clothing, etc., are protected from theft or other unauthorized removal from a protected area by securing to the articles a responder, otherwise known as a target, and providing a target monitor at each exit from the protected area. The target comprises an elongated strip of magnetically soft, i.e. easily saturable, low coercivity material. A transmitter and a receiver are provided with antennas located at the exit from a protected area. The transmitter generates a continuous alternating magnetic field at the exit; and when an article with a target attached is carried through the exit, the target is magnetically saturated successively in opposite directions by the alternating magnetic field and thereby produces distinctive disturbances of the field. The thus disturbed field is received by the receiver which in turn produces corresponding electric signals. The receiver then processes these electric signals and selects those corresponding to the particular distinctive disturbances produced by the targets. These selected signals are then used to actuate an alarm.

U.S. Pat. No. 5,029,291 in the names of Y. Peter Zhou et al, and also assigned to the assignee of the present invention, shows and describes a novel sensor element which is suitable for use as a responder or target in an electronic article surveillance system of the general type shown and described in the above mentioned patent to Buckens. The sensor element of the Zhou et al patent has a magnetic hysteresis characteristic having a different slope in one direction of magnetization than in the opposite direction of magnetization. Also, the slope in one direction of magnetization is very steep; and when the responder is subjected to a changing magnetic field, it produces disturbances of that field in the form of very sharp pulses.

The sensor element of the Zhou et al patent comprises a first layer of a cobalt-iron alloy containing a metalloid element such as boron and/or silicon and a second layer comprising a complex metal-metalloid compound formed from the first layer with the first and second layers being exchange coupled. As described in the patent, the sensor element is made by placing an element comprising the first layer as a substrate in a furnace containing an oxidizing atmosphere and heating the element at a temperature of 260°–420° for a period of two hours to eighty hours, until a film forms on the substrate. During the heating process electrical coils, such as Helmholtz coils, are energized to produce a magnetic field of about 0.3 oersteds along the length of the oxidized substrate while the substrate is isolated from all other magnetic fields, including the earth's magnetic field. This magnetic field is maintained until the furnace is cooled down.

SUMMARY OF THE INVENTION

It has been discovered that the coercivity of the sensor element of the Zhou, et al. patent is dependent on the value of the magnetic field applied to it during the heating process. It has also been discovered that when several such elements, each having been made by application of a different value of applied magnetic field during heating, are subjected to a changing magnetic field, each will undergo a magnetic saturation reversal at a different value of the applied magnetic field and will produce a sharp response pulse at a different time.

The present invention, in one aspect, involves a novel responder for use in an electronic article surveillance system. This novel responder comprises at least two closely spaced elongated, easily saturable, low magnetic coercivity, magnetizable elements, each element having a different magnetic coercivity, whereby when the elements are subjected to a changing magnetic field, they are each driven from magnetic saturation in one direction to magnetic saturation in the opposite direction at a different time. Means are provided for mounting the elements in closely spaced relation on an article to be protected.

According to another aspect of the invention there is provided a novel method for making a responder for an electronic article surveillance system. This novel method comprises the steps of providing a plurality of easily saturable, low magnetic coercivity magnetizable elements and mounting the elements in closely spaced relationship on an article to be protected so that when the elements are subjected to a changing magnetic field, each element will be driven from magnetic saturation in one direction to magnetic saturation in the opposite direction at a different time.

According to a further aspect of the invention there is provided a novel electronic article surveillance system. This novel system comprises an interrogator arranged to generate a cyclically changing magnetic field in an interrogation zone and a receiver arranged to detect the occurrence of pulses produced by responders in the zone. The receiver includes a timing circuit arranged to measure the duration between successive detected pulses during each cycle of the varying magnetic field and to produce an output signal in response to a predetermined duration.

According to a still further aspect, the present invention involves a novel method of detecting the presence of a responder having a plurality of closely spaced, easily saturable, low coercivity, magnetizable elements, each element having a different magnetic coercivity. This novel method comprises the steps of generating a changing magnetic field capable of driving each of the elements from magnetic saturation in one direction to magnetic saturation in the opposite direction so that the elements produce detectable pulses at different times, detecting the pulses thus produced, measuring the time between successive pulses and producing an output signal when the measured time is at a predetermined value.

In another aspect, the present invention involves a novel apparatus for generating interrogation signals for electronic article surveillance. This apparatus comprises a signal generator for generating a repetitive sine wave signal and a signal processor arranged to invert the polarity of alternate cycles of the sine wave signal output from said signal generator at a phase corresponding to a maximum amplitude of said output. This results in a signal whose rate of change is minimal at near zero output.

In a further aspect, the present invention involves a novel electronic article surveillance system of the type in which responders attached to article to be protected become reversely saturated by a cyclically varying magnetic interrogation field. This system includes an interrogation field generator constructed and arranged to produce a signal which varies cyclically between two extremes and which is characterized by a minimum rate of change midway between said two extremes.

The present invention, in another aspect, involves a novel receiver for an electronic article surveillance system which incorporates, on articles to be protected, responders which produce distinctive disturbances to a cyclically varying interrogation field at a plurality of different times during each cycle of variation of said field. This novel receiver comprises a pulse generator arranged to produce a pulse in response to each distinctive disturbance and a timer arranged to measure the duration between successive pulses within a cycle and to produce an alarm in response to the occurrence of a predetermined duration.

BRIEF DESCRIPTION OF THE DRAWINGS

FIG. 1 is a perspective view of an article to be protected and having mounted thereon a responder according to the present invention;

FIG. 2 is an enlarged perspective view of the responder of FIG. 1;

FIG. 3 is an end view of the responder of FIG. 2;

FIG. 4 is an enlarged view taken along line 4—4 of FIG. 2;

DETAILED DESCRIPTION OF THE PREFERRED EMBODIMENTS

Figure 5:
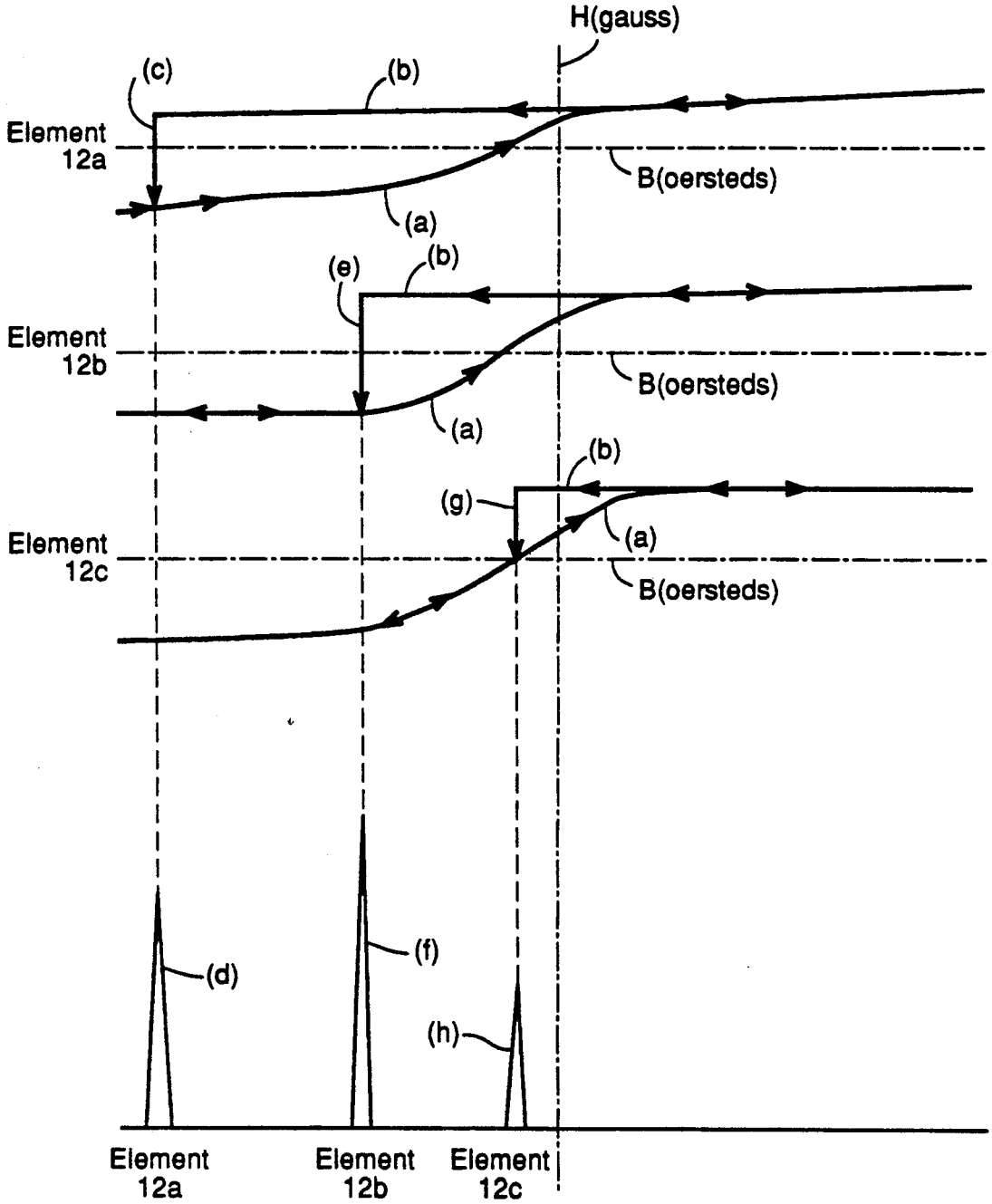
FIG. 5 is a series of graphs showing the magnetic characteristics and resulting pulse producing characteristics of different portions of the responder of FIGS. 1-4.

As shown in FIG. 1, an article 10 such as a package containing merchandise to be protected, is provided with a responder (also known as a "target") 12, which is fastened securely to the article, for example by glue or other adhesive. The responder 12 is provided with three active elements 12*a*, 12*b* and 12*c* in the form of elongated strips in parallel, closely spaced arrangement. As shown in FIGS. 2 and 3, the active elements 12*a*, 12*b* and 12*c* are mounted on a common substrate 14. If desired, a cover sheet (not shown) of paper or similar material may be provided to cover and conceal the elements 12*a*, 12*b* and 12*c*.

Each of the elements 12*a*, 12*b* and 12*c* is a strip of low magnetic coercivity magnetizable material which is easily magnetically saturated. When each element is exposed to a magnetic interrogation field and is driven by the field from magnetic saturation in one direction in one direction to magnetic saturation in the opposite direction, the element disturbs the interrogation field by generating a distinctive pulse. Preferably, each of the elements 12*a*, 12*b* and 12*c* is made of a cobalt alloy which has been heated in an oxidizing atmosphere to form an oxide coating thereon and which has been thereafter cooled in the presence of a magnetic field along its length, as shown and described in U.S. Pat. No. 5,029,291.

The enlarged cross-section view of FIG. 4 shows the element 12*a* as so formed. As can be seen, the element has a core 16 with an oxide coating 18. The coating 18 is actually much thinner than as shown. The elements 12*a*, 12*b* and 12*c* in this embodiment may have a length of 1.25 inches (31.8 mm) to 7 inches (17.8 cm) and cross sectional dimensions of about 0.0625 inches (1.6 mm) by 0.0013 inches (0.033 mm). The oxide coating 18, as shown, covers the entire surface of the core 16.

The magnetic hysteresis loops of the three responder elements 12*a*, 12*b* and 12*c* and the derivatives of those loops, which correspond to the pulse signals produced by each element are shown in FIG. 5. As can be seen, the hysteresis loop for the element 12*a* comprises a forward path (a) from saturation in the negative direction to saturation in the positive direction and a reverse path (b) from saturation in the forward direction to saturation in the reverse direction. The forward path (a) is characterized by a gradual or shallowly sloped rise; and while the derivative of this slope has a positive value, it is quite small and is not shown in FIG. 5. The reverse path (b), from saturation in the forward direction to saturation in the reverse direction, is characterized by a sudden drop at about 0.6 oersteds (point (c)), which produces a corresponding large pulse (d).

The hysteresis loop of element 12*b* is qualitatively similar to that of element 12*a* except that its reverse path (b) is characterized by a sudden, and somewhat larger, drop at about 0.3 oersteds (point (e)) and a correspondingly large pulse (f).

The hysteresis loop of element 12*c* is also similar except that its reverse path (b) is characterized by a sudden, and somewhat smaller, drop at about 0.075 oersteds (point (g)), and a smaller, yet still very prominent, pulse (h).

Because the hysteresis loops of the three elements 12*a*, 12*b* and 12*c* are characterized by a sudden change in magnetization at different magnetic field intensities (e.g. 0.6, 0.3 and 0.075 oersteds) they produce separate pulses (d), (f) and (h) which are spaced apart in time when they are subjected to a time varying magnetic interrogation field. Thus the composite responder 12 has a very unique overall magnetic characteristic which makes it produce an unusual and easily distinguishable pulse pattern.

The elements 12*a*, 12*b* and 12*c* are preferably prepared according to the overall teachings of U.S. Pa. No. 5,029,291. However, whereas the sensor element in that patent was prepared by maintaining a magnetic field of about 0.3 oersteds during the cooling step after heating to produce an oxide film, the sensor elements 12*a*, 12*b* and 12*c* are subjected to magnetic field strengths of 0.025, 0.1 and 0.3 oersteds respectively. These magnetic fields are directed along the length of the respective elements while the elements are being cooled from their oxidizing temperature (260°-420° C.). At the same time, the elements 12*a*, 12*b* and 12*c* are isolated from the effects of all other magnetic fields, including the earth's magnetic field, by means of magnetic shields or equivalent techniques.

It has been found that by controlling the intensity of the magnetic field along the length of the element during the heating operation, at least until the element is cooled. It has been found, at least for the compositions described herein that such control is effective to produce switching points between about 0.6 and 0.075 oersteds by use of an applied magnetic field over a range of 0.025 and 1.0 oersted during the cooling step. Significantly higher or lower applied fields will result in a loss of asymmetry.

The elements 12*a*, 12*b* and 12*c* are preferably prepared using a substrate 14 (FIG. 4) of an alloy of cobalt which contains iron and boron and/or silicon. The presently preferred formula for the substrate formula is $Co_{(x)}Fe_{(75-x)}Si_{10}B_{15}$ where x=10 to 72.5 and wherein x and the other subscripts are given in atomic percent. The following formulas are the most preferred: $Co_{68.5}Fe_{6.5}Si_{10}B_{15}$ and $Co_{70.5}Fe_{4.5}Si_{10}B_{15}$. The first composition, i.e. containing $Fe_{6.5}$ provides a high degree of asymmetry in the hysteresis characteristic. The second composition, i.e. containing $Fe_{4.5}$ provides somewhat less asymmetry but significantly improved resistance to deterioration from cutting and bending. The microstructure of the substrate 14 may be either crystalline or amorphous or a combination; however to avoid excessive brittleness where the principal component is cobalt, it is preferred that the substrate be at least partially amorphous.

Figure 6:
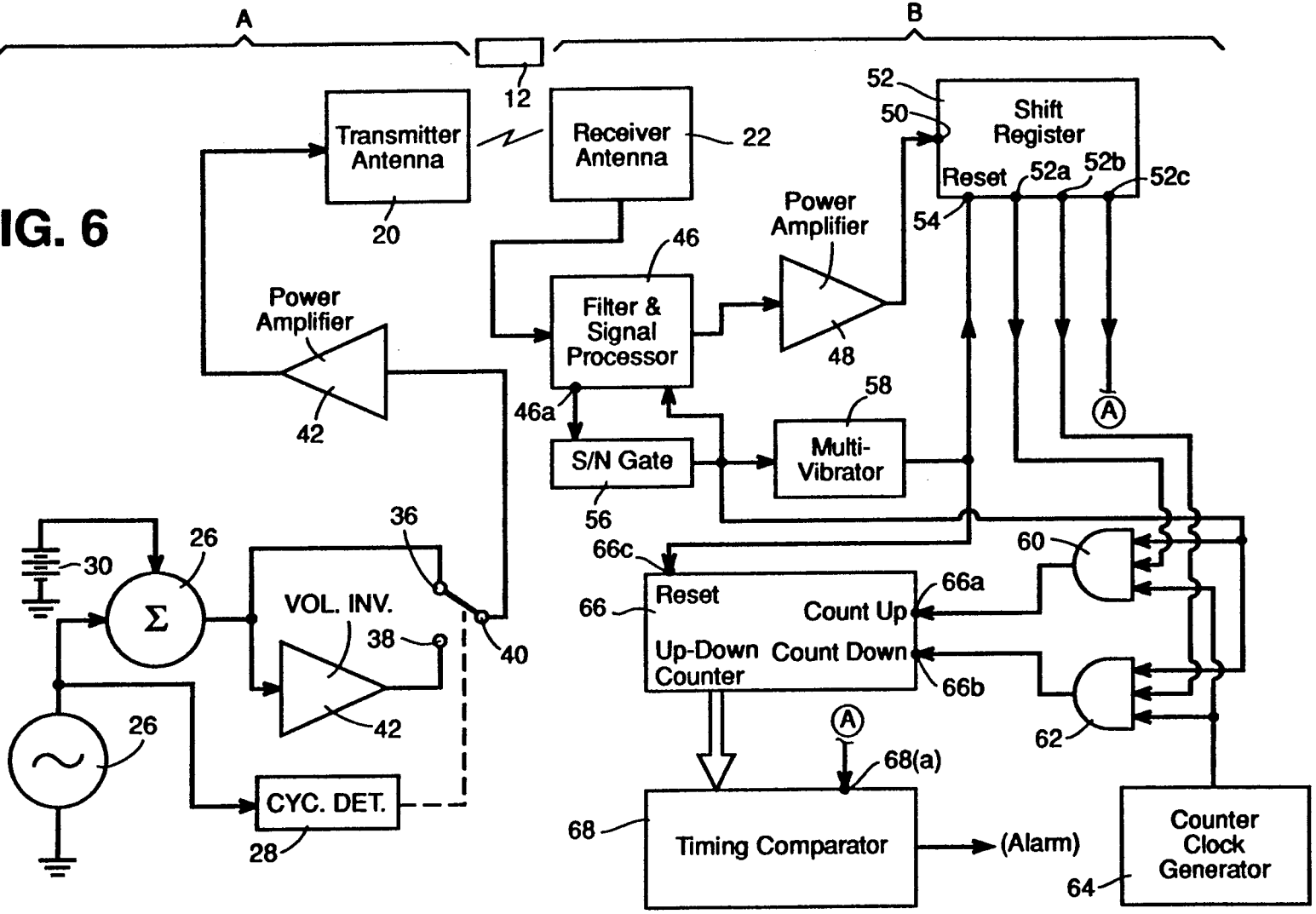
FIG. 6 is a block diagram of a novel article surveilance system according to the present invention.

The block diagram of FIG. 6 shows a detection system for making use of the special response characteristics of he above described responder. The system shown in FIG. 6 includes an interrogation portion A having a transmitter antenna 20 and a receiver portion B having a receiver antenna 22. A responder 12 which is brought between the transmitter and receiver antennas 20 and 2 is interrogated by a cyclically varying magnetic interrogation field generated in the interrogation portion A and transmitted from the transmitter antenna to the responder 12. The responder 12 disturbs the interrogation field in a distinctive manner to produce a characteristic pulse pattern as described above; and the so disturbed interrogation field is received in the receiver antenna 22 and processed in the receiver portion B to produce an alarm output.

Figure 7:
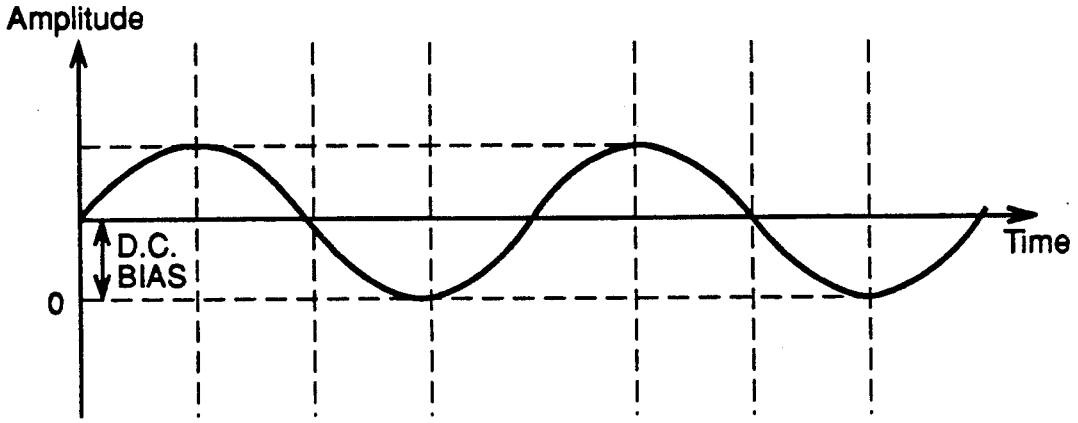
FIG. 7 is a waveform of a magnetic interrogation field used in prior art article surveillance systems.

The transmitter portion A comprises a sine wave signal generator 24 whose output is fed to a summing circuit 26 as well as to a cycle detector 28. A direct current bias source 30 is also connected to the summing circuit. As shown in FIG. 7, the voltage of the bias source 30 raises the output of the signal generator 24 so that its low points touch zero voltage.

The output of the summing circuit 26 is then supplied to two channels 32 and 34 which terminate at alternate switch points 36 and 38 of an electronic switch 40 (shown as a mechanical switch for illustration). A voltage invertor 42 is interposed in the channel 34 to reverse the voltage it receives from the summing circuit 26. Thus the output of the voltage invertor 42, which is applied to the switch point 38, is the inverse of that shown in FIG. 7. That is, the voltage at the switch point 38 varies only negatively from its high points which touch zero voltage.

Figure 8:
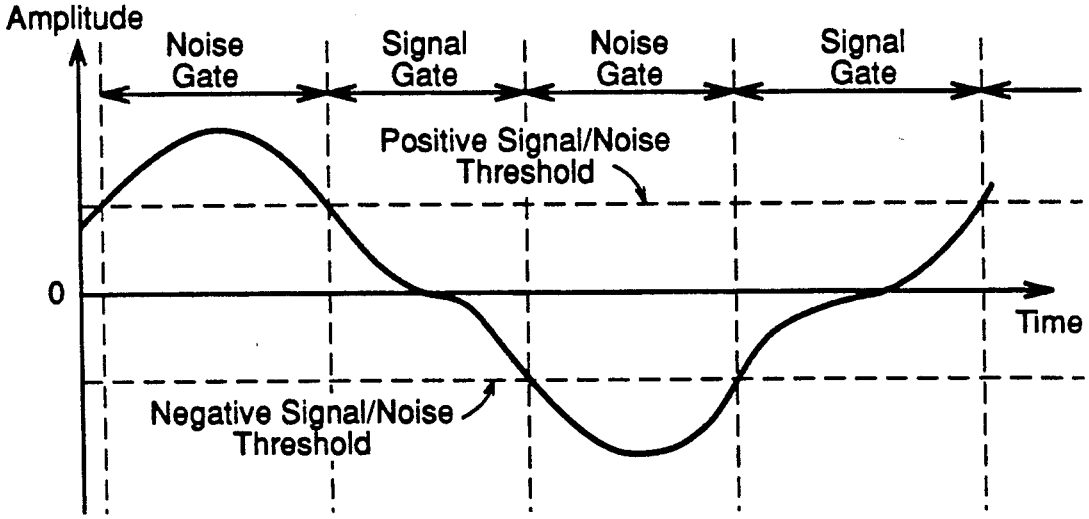
FIG. 8 is a waveform of a magnetic interrogation field used in an article surveillance system in one aspect of the present invention.

The cycle detector 28 detects the occurrence of each low point of the output of the sine wave signal generator 24; and in response, it produces an output to change the condition of the switch 40. As a result, the output from the switch 40 is a modified wave, as shown in FIG. 8, which is characterized first, by the fact that in the zero voltage region, the rate of change in voltage is at a minimum and second, by the fact that the duration of a full cycle of voltage variation is doubled. The significance of this is that the time between adjacent pulses from the responder 12 is lengthened.

The output from the switch 40 is supplied to a power amplifier 42 and from there to the transmitter antenna 20. The transmitter antenna 20 generates in an interrogation region 44, through which articles carrying responders 12 must pass, a cyclically varying magnetic field whose intensity follows the pattern of FIG. 8. This field causes the elements 12*a*, 12*b* and 12*c* of the responder 12 (FIGS. 1-4) to produce pulses at different times, namely when the intensity of the generated magnetic field is at the switching points (c), (e) and (g) (FIG. 5), respectively, of the elements 12*a*, 12*b*, and 12*c*. Now, these switching points occur when the field is near zero; and because the magnetic field pattern of FIG. 8 is such that it varies most slowly in the region nearest zero intensity, the spacing between successive pulses is effectively increased. This makes it easier to measure the time duration between successive pulses.

Figure 9:
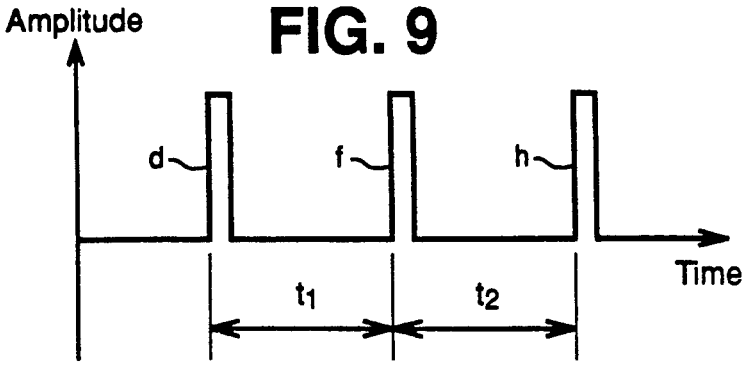
FIG. 9 is a stylized waveform showing the timing of pulses produced by a novel responder according to the present invention.

The receiver portion B of the system of FIG. 6 is arranged to produce an alarm output in response to the occurrence of a series of pulses in a predetermined time relationship. In the present case, the responder 12 has three elements 12*a*, 12*b* and 12*c* which produce pulses at three substantially equally spaced time intervals, as shown in FIG. 9. Therefore, when a time duration $t_1$ between the first and second pulses (d) and (f) (FIG. 5) in an interrogation cycle is the same or substantially the same as the time duration $t_2$ between the second and third pulses (f) and (h) an alarm signal will be produced. The receiver portion B of FIG. 6 is constructed to produce an alarm signal when these two time durations are substantially equal.

As shown in FIG. 6, the magnetic fields received by the receiver antenna 22 are supplied as electrical signals to filter and signal processing circuits 46. These circuits are well known per se and are not relevant to the best mode for carrying out this invention. Circuits such as shown in U.S. Pat. No. 4,623,877 can be used. The filter and signal processor 46 separate out the disturbances in the received magnetic fields and produce pulses corresponding to those disturbances. The pulses produced in the filter and signal processing circuits 46 are supplied through a power amplifier 48 to the input terminal 50 of a shift register 52. The shift register 50 also has three output terminals 52*a*, 52*b* and 52*c* and a reset terminal 54. The filter and signal processing circuits 46 also produce an output at a signal/noise terminal 46*a* corresponding to the amplitude of the varying magnetic field received from the transmitter portion A. This signal is applied to a signal/noise gate circuit 56. The signal/noise gate circuit is preset to produce a positive output only when the amplitude of the received magnetic field is between preset positive and negative signal/noise threshold levels, as shown in FIG. 8. During the intervals when the amplitude of the received magnetic field is outside these threshold limits, it is too high to cause a change in the direction of magnetization of true responders; and therefore, if any pulses occur during these intervals, they are disregarded. The signal/gate circuit 56 thus produces a positive output, also known as a signal gate, only while the amplitude of the received magnetic field is between the preset threshold limits.

The signal gate from the signal/noise gate circuit 56 is applied to the filter and signal processor circuits 46 to allow them to supply pulses to the power amplifier 48 and the shift register 52 only during the signal gate intervals.

The output of the signal/gate circuit 56 is also applied to a one shot multivibrator 58 which generates a pulse in response to beginning of each positive output from the signal/gate circuit, that is, at the onset of each signal gate. This pulse is applied to the reset terminal 54 of the shift register 50. Thus, at the beginning of each signal gate, the shift register 50 is reset. The shift register is constructed such that when a signal is applied to its reset terminal 54, none of its output terminals 52*a*, 52*b* or 52*c* produces any output until the next pulse is received at its input terminal 50. The first pulse received at the input terminal 50 causes the output terminal 52*a* to produce a continuous positive output until the next pulse is received at the input terminal 50. This second pulse removes the output from the terminal 52*a* and causes the terminal 52*b* to produce a continuous positive output. A third pulse removes the output from the terminal 52*b* and causes the terminal 52*c* to produce a continuous positive output. However, if a reset pulse is received from the multivibrator 58, all output is removed from the terminals 52*a*, 52*b* and 52*c* ; and when the next pulse is received at the terminal 50 it will cause the first output terminal 52*a* to produce a positive output.

There are also provided a count up AND gate 60 and a count down AND gate 62. The count up AND gate 60 receives inputs from the signal/noise gate circuit 56, the first output terminal 52*a* of the shift register 52 and from a counter clock generator 64. The counter clock generator operates continuously to generate high frequency timing pulses. The count down AND gate 62 receives inputs from the signal/noise gate circuit 56, the second output terminal 52*b* of the shift register 52 and from the counter clock generator 64.

The output of the count up AND gate 60 is applied to a count up input terminal 66*a* of an up/down counter 66 and the output of the count down AND gate 62 is applied to a count down terminal 66*b* of the up/down counter 66. The up/down counter 66 also has a reset terminal 66*c* which is connected to receive pulses from the multivibrator 58. Whenever a reset pulse is received at the reset terminal 66*c*, the count in the up down counter 66 is reset to zero count. The count in the up/-down counter 66 is continuously supplied to a timing comparator 68. Finally, the third output terminal 52*c* of the shift register 52 is applied to the timing comparator 68.

In operation, the receiver portion B receives the varying magnetic field generated by the transmitter portion A; and it produces pulses in response to the disturbances present on that varying magnetic field. As explained above, the signal/gate circuits 56 generate signal gates which are applied to the filter and signal processor circuits 46 so that they produce output pulses only during the signal gates. Also, the signal/gate circuits 56 operate through the one shot multivibrator 58 to reset the shift register 52 and the up down counter 66 at the beginning of each signal gate.

As explained above in connection with FIG. 5, the responder 12 is capable of producing three spaced apart pulses during each passage of the transmitted magnetic field between the positive and negative signal/noise thresholds. For purposes of explanation, it will be assumed the pulses are substantially equally spaced apart from each other, although as will be readily seen the principles of the present invention can be employed to detect responders which produce pulses at different spacing, or responders which produce a different number of pulses during each passage of the transmitted magnetic field between the positive and negative signal/noise thresholds.

The first pulse to occur within a signal gate interval produces a positive output at the first output terminal 52*a* of the shift register 52 and this output is applied to the count up AND gate 60. As a result, the count up AND gate will pass the pulses being generated by the counter clock generator 64. These pulses are applied to the count up terminal 66*a* of the up down counter 66. The count in the counter 66 continues to increase until the second pulse arrives at the shift register 52, at which time the positive output is removed from the first output terminal 52*a* and a positive output is produced at the second output terminal 52*b*. This causes the count up AND gate 60 to stop passage of pulses from the counter clock generator to the count up terminal 66*a* of the up down counter 66. At the same time the positive output from the second terminal 52*b* of the shift register 52 causes the count down AND gate 62 to pass signals from the counter clock generator 64 to the count down terminal 66*b* of the up down counter 66. These pulses cause the counter 66 to count down from the count it had attained during the interval between the first and second pulses from the filter and signal processor circuits 46.

The third pulse applied to the shift register 52 during the signal gate interval removes the positive output from the second output terminal 52*b* and causes a positive output to occur from the third output terminal 52*c*. The removal of the positive output from the second terminal 52*b* causes the down count AND gate 62 to prevent passage of pulses from the counter clock generator to the count down terminal 66*b* of the up down counter. At the same time the positive output from the third output terminal 52(*c*) is applied to an alarm signal input terminal 68(*a*) of the timing comparator 68. The timing comparator 68 is set so that if the count present therein from the up down counter 66 is less than a predetermined value at the time a signal is applied to its alarm signal input terminal 68(*a*), an alarm output (ALARM) will be produced. However, if the count in the counter is greater than the predetermined threshold then the timing comparator 68 will not produce an alarm output in response to inputs at its terminal 68(*a*).

When the count in the counter 68 is at zero, this corresponds to an equal spacing between the three successive pulses produced by the elements 12*a*, 12*b* and 12*c* of the responder 12. In cases where the responder elements produce a different pulse spacing, the timing comparator 68 can be set to produce an alarm in response to a signal at its terminal 68(*a*) only when a predetermined positive or negative count is present in the up down counter.

It will also be appreciated that other schemes may be used to measure the duration between successive pulses produced by the elements on the responder 12.

We claim:

1. A method for making a responder for an electronic article surveillance system, said method comprising the steps of providing a first layer of an alloy of ferromagnetic material characterized by a magnetic coercivity less than three oersteds and subjecting said first layer to oxidation to form thereon a second layer which is exchange coupled with said first layer thereby providing an easily saturable low magnetic coercivity magnetic element, providing a plurality of so formed elements and mounting said elements in closely spaced relationship on an article to be protected so that when said elements are subjected to a changing magnetic field, each element will be driven from magnetic saturation in one direction to magnetic saturation in the opposite direction at a different time.

2. A method according to claim 1, wherein said first layer is of a ferromagnetic material which, when subjected to an oxidizing atmosphere, forms said second layer.

3. A method according to claim 1, wherein said first layer is a cobalt alloy.

4. A method according to claim 3, wherein said first layer has a composition corresponding to the formula $CO_{(x)}Fe_{(75-x)}Si_{10}B_{15}$ where x is in the range of 10 to 72.5 and x and the other subscripts are given in atomic percent.

5. A method according to claim 4, wherein x=68.5.

6. A method according to claim 4, wherein x=70.5.

7. A method according to claim 1, wherein said first layer is subjected to oxidation in a gas from the group consisting of air and a mixture of oxygen and an inert gas.

8. A method according to claim 1, wherein said first layer is subjected to oxidation at a temperature in the range of 260°–420° C. for a period of two to eighty hours.

9. A method according to claim 8, wherein said first layer is cooled from said temperature in the presence of a magnetic field directed along the length of said first layer.

10. A method according to claim 9, wherein said magnetic field is in the range of 0.025 and 1.0 oersted.

11. A method according to claim 9, wherein the coercivity of said magnetic field is different during the formation of different ones of said elements.

12. An electronic article surveillance system comprising an interrogator arranged to generate a cyclically changing magnetic field in an interrogation zone and a receiver arranged to detect the occurrence of pulses produced by responders in said zone, said receiver including a timing circuit arranged to measure the duration between successive detected pulses which occur within each cycle of said varying magnetic field and to produce an output signal in response to a predetermined duration between said successive detected pulses, said interrogator being constructed and arranged to produce a cyclically changing magnetic field whose rate of change is minimal in the vicinity of zero field.

13. An electronic article surveillance system comprising an interrogator arranged to generate a cyclically changing magnetic field in an interrogation zone and a receiver arranged to detect the occurrence of pulses produced by responders in said zone, said receiver including a timing circuit arranged to measure the duration between successive detected pulses which occur within each cycle of said varying magnetic field and to produce an output signal in response to a predetermined duration between said successive detected pulses, said receiving timing circuit comprising a clock pulse generator, and up/down counter and gate circuits interposed between said clock pulse generator and up count and down count input terminals of said up/down counter, said gate circuits being arranged to open in alternate intervals between successive pulses.

14. A method of detecting the presence of a responder having a plurality of closely spaced, easily saturable, low coercivity, magnetizable elements, each element having a different magnetic coercivity, said method comprising the steps of generating a cyclically changing magnetic field to drive each of the elements from magnetic saturation in one direction to magnetic saturation in the opposite direction so that the elements produce detectable pulses at different times, detecting the pulses thus produced, measuring the time between successive detected pulses which occur within each cycle of said changing magnetic field and producing an output signal when the measured time is at a predetermined value, said step of generating a changing magnetic field being carried out such that the rate of change of said field is minimal in the vicinity of zero field.

15. Apparatus for generating interrogation signals for electronic article surveillance, said apparatus comprising a signal generator for generating a repetitive sine wave signal and a signal processor arranged to invert the polarity of alternate cycles of the sine wave signal output from said signal generator at a phase corresponding to a maximum amplitude of said output.

16. In an electronic article surveillance system of the type in which responders attached to article to be protected become reversely saturated by a cyclically varying magnetic interrogation field, an interrogation field generator constructed and arranged to produce a signal which varies cyclically between two extremes and which is characterized by a minimum rate of change midway between said two extremes.

17. A receiver for an electronic article surveillance system which incorporates, on articles to be protected, responders which produce distinctive disturbances to a cyclically varying interrogation field at a plurality of different times during each cycle of variation of said field, said receiver comprising a pulse generator arranged to produce a pulse in response to each distinctive disturbance and a timer arranged to measure the duration between successive pulses which occur within a cycle and to produce an alarm in response to said duration being a predetermined amount, said timer comprising a clock pulse generator, an up/down clock pulse counter and gate circuits interposed between said clock pulse generator and up and down count input terminals of said up/down counter, said gate circuits being arranged to be open in alternate intervals between successive pulses to allow clock pulses to be applied to and to be counted in said counter, one of said gate circuits being connected to be opened in response to the detection of a first pulse within a cycle and to be closed in response to the detection of the next successive pulse within said cycle.

18. A method of detecting the presence of a responder having a plurality of closely spaced, easily saturable, low coercivity, magnetizable elements, each element having a different magnetic coercivity, said method comprising the steps of generating a changing magnetic field to drive each of the elements from magnetic saturation in one direction to magnetic saturation in the opposite direction so that the elements produce detectable pulses at different times, detecting the pulses thus produced, measuring the time between successive detected pulses which occur within each cycle of said changing magnetic field and producing an output signal when the measured time is at a predetermined value, said step of measuring the time between successive detected pulses including the steps of generating clock pulses, applying said clock pulses through a first gate circuit to an up count terminal of an up/down counter upon the occurrence of a first detected pulse in a cycle, then terminating the application of said clock pulses to said counter upon the occurrence of the next successive detected pulse in said cycle, and thereafter applying said clock pulses through a second gate circuit to a down count terminal of said up/down counter.

* * * * *